US011500316B2

(12) United States Patent
Uehara et al.

(10) Patent No.: US 11,500,316 B2
(45) Date of Patent: Nov. 15, 2022

(54) FIXING DEVICE AND IMAGE FORMING APPARATUS

(71) Applicant: KYOCERA Document Solutions Inc., Osaka (JP)

(72) Inventors: Masakazu Uehara, Osaka (JP); Tomohiro Watatani, Osaka (JP); Yuhiro Sakai, Osaka (JP); Fumito Nakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/244,270

(22) Filed: Apr. 29, 2021

(65) Prior Publication Data

US 2021/0341861 A1 Nov. 4, 2021

(30) Foreign Application Priority Data

Apr. 30, 2020 (JP) ..... JP2020-080351

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2053; G03G 2215/2003
See application file for complete search history.

(56) References Cited

U.S. PATENT DOCUMENTS

2018/0196378 A1* 7/2018 Takagi ..... G03G 15/2053

FOREIGN PATENT DOCUMENTS

JP 4599189 B2 12/2010

* cited by examiner

*Primary Examiner* — Thomas S Giampaolo, II
(74) *Attorney, Agent, or Firm* — Studebaker & Brackett PC

(57) ABSTRACT

A heater holding member circulatably guides a fixing belt and holds a heater that heats the fixing belt. A stay sheet metal reinforces the heater holding member. The heater holding member has a base plate and side walls. The stay sheet metal is placed on the base plate. A side wall is erected on either side of the base plate in a short direction thereof. A pocket which keeps the stay sheet metal is formed in each side wall. The stay sheet metal has a top plate and side plates. A side plate bends and extends from either edge of the top plate in a short direction thereof. A slit is formed in each side plate such that the side plates are kept in the pockets of the heater holding member.

3 Claims, 12 Drawing Sheets

FIXING DEVICE AND IMAGE FORMING APPARATUS

INCORPORATION BY REFERENCE

The present application claims priority under 35 U.S.C. § 119 to Japanese Patent Application No. 2020-080351, filed on Apr. 30, 2020. The contents of this application are incorporated herein by reference in their entirety.

BACKGROUND

The present disclosure relates to a fixing device and an image forming apparatus.

An image-heating device has been disclosed which includes a support member that supports a heater.

SUMMARY

A fixing device according to an aspect of the present disclosure includes a fixing belt, a heater holding member, and a stay sheet metal. The fixing belt heats a sheet. The heater holding member circulatably guides the fixing belt and holds a heater which heats the fixing belt. The stay sheet metal reinforces the heater holding member. The heater holding member has a base plate and side walls. The stay sheet metal is placed on the base plate. A side wall is erected on either side of the base plate in a short direction thereof. A pocket which keeps the stay sheet metal is formed in each side wall. The stay sheet metal has a top plate and side plates. A side plate bends and extends from either edge of the top plate in a short direction thereof. A slit is formed in each side plate such that the side plates are kept in the pockets of the heater holding member.

An image forming apparatus according to another aspect of the present disclosure includes the above fixing device and an image forming section. The image forming section forms a toner image on the sheet.

DETAILED DESCRIPTION

First Embodiment

Figure 1:
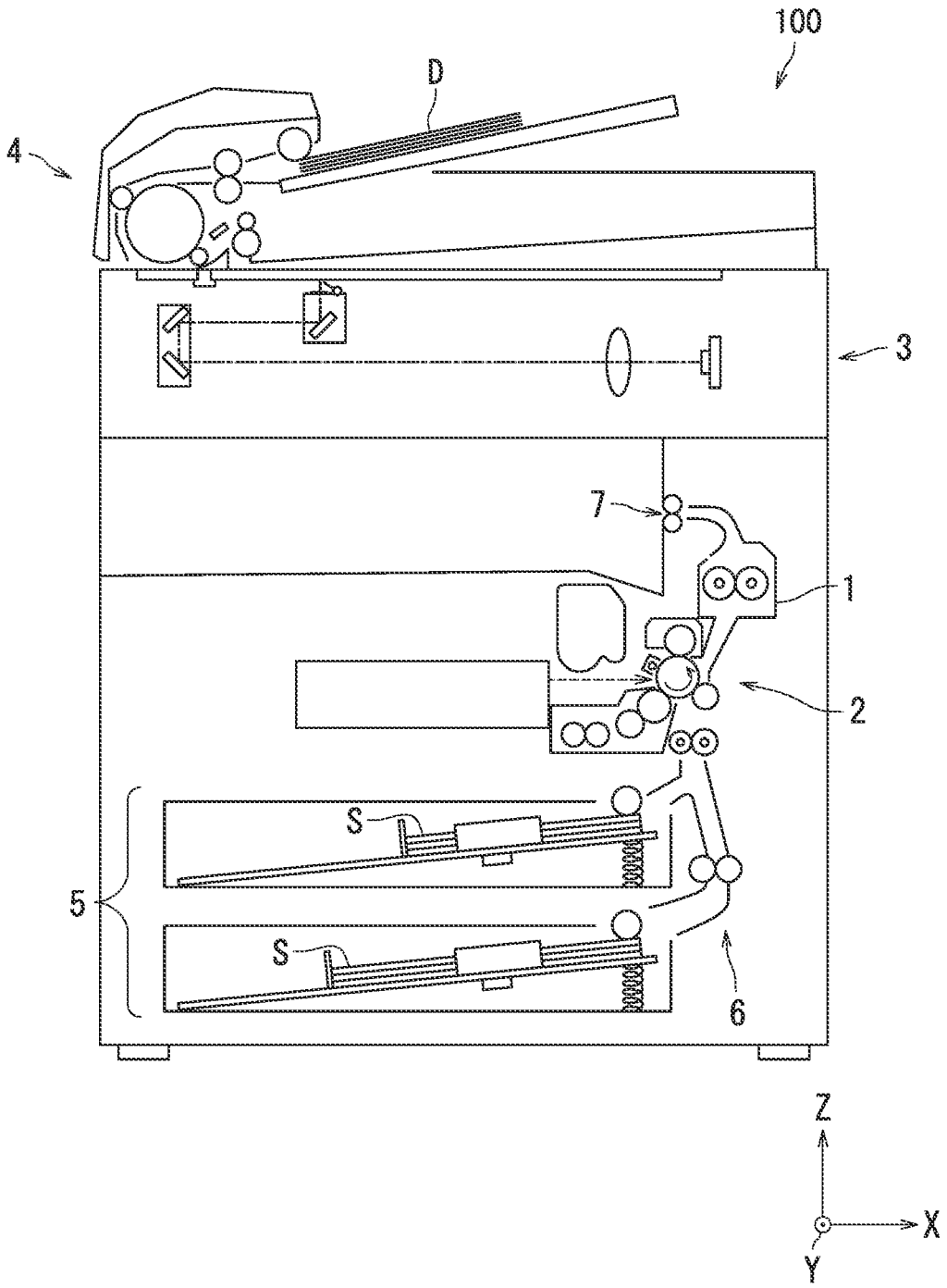
FIG. 1 is a diagram illustrating an image forming apparatus including a fixing device according to a first embodiment of the present disclosure.

The following describes an embodiment of the present disclosure with reference to the accompanying drawings. Note that elements that are the same or equivalent are labeled with the same reference signs in the drawings and description thereof is not repeated. Mutually orthogonal X, Y, and Z axes are indicated in the drawings of the present embodiment. The Z axis is parallel to a vertical plane, and the X and Y axes are parallel to a horizontal plane.

An image forming apparatus 100 according to the first embodiment of the present disclosure is described with reference to FIG. 1. FIG. 1 is a diagram illustrating the image forming apparatus 100 in the first embodiment. Examples of the image forming apparatus 100 include a copier, a facsimile machine, and a multifunction peripheral which combines the functions of a copier and a facsimile machine. In the first embodiment, the image forming apparatus 100 is a monochrome multifunction peripheral.

As illustrated in FIG. 1, the image forming apparatus 100 includes a fixing device 1, an image forming section 2, a reading section 3, a document conveyor device 4, a feeder 5, a conveyance section 6, and an ejection section 7.

The feeder 5 feeds a sheet S. The feeder 5 may include a tray and a pickup roller. The tray carries the sheet S. The pickup roller picks up and feeds the sheet S on the tray. The sheet S is an example of a recording medium.

The conveyance section 6 conveys the sheet S fed from the feeder 5. The conveyance section 6 may include a conveyance roller and a registration roller on the conveyance path of the conveyance section 6. The conveyance roller may be arranged in a plurality thereof on the conveyance path, and conveys the sheet S.

The registration roller regulates the timing at which the sheet S is conveyed to the image forming section 2. The conveyance section 6 conveys the sheet S from the feeder 5 to the ejection section 7 by way of the image forming section 2 and the fixing device 1.

The image forming section 2 electrographically forms an unillustrated toner image on the sheet S based on image data. The image data indicates an image of a document D, for example. The image forming section 2 includes a photosensitive drum, a charger, a light exposure device, a development device, a replenishing device, a transfer roller, a cleaner, and a static elimination device, for example.

The fixing device 1 applies heat and pressure to the toner image to fix the toner image to the sheet S.

The ejection section 7 ejects the sheet S out of the casing of the image forming apparatus 100. The ejection section 7 may include an ejection roller and an exit tray. The ejection roller ejects the sheet S conveyed from the fixing device 1 by the conveyance roller onto the exit tray. The exit tray carries the ejected sheet S.

The document conveyor device 4 conveys the document D. An example of the document conveyor device 4 is an auto document feeder (ADF).

The reading section 3 reads the image of the document D conveyed by the document conveyor device 4. The reading section 3 generates image data from the read image. An example of the reading section 3 is a contact image sensor (CIS) or charged-coupled device (CCD) scanner.

Figure 2:
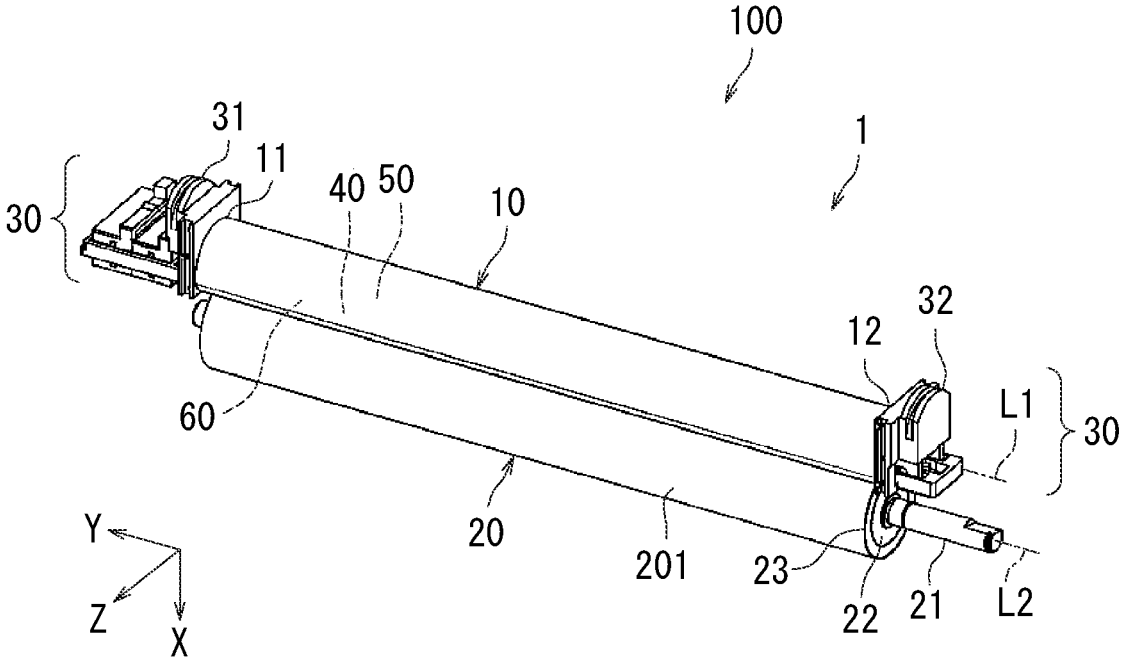
FIG. 2 is a perspective view of a main part of the fixing device in the first embodiment.
Figure 3:
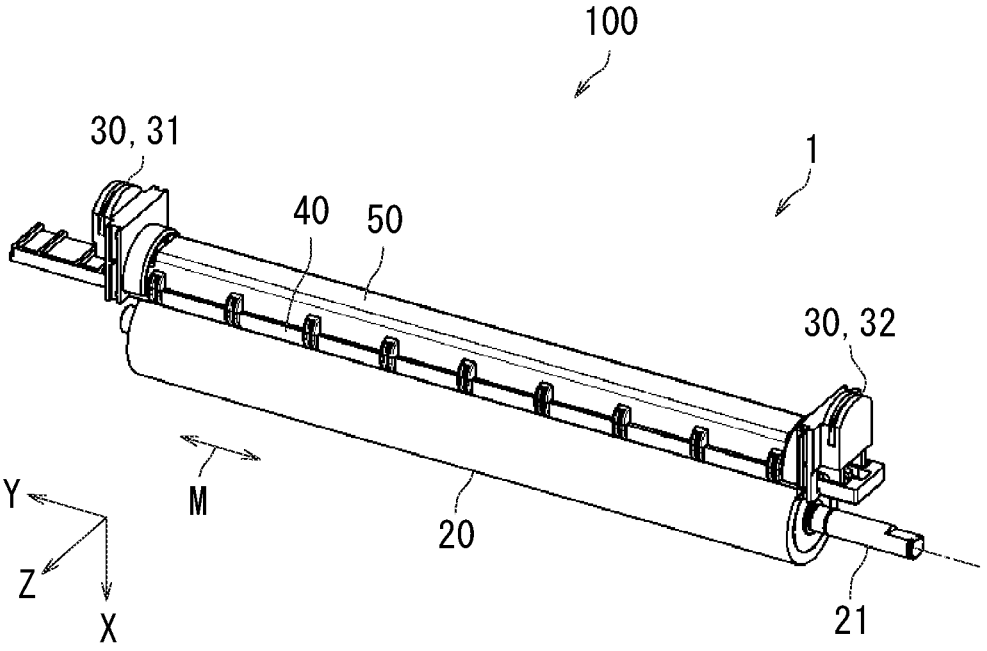
FIG. 3 is an outer perspective view of the fixing device in the first embodiment with a fixing belt removed therefrom.
Figure 4:
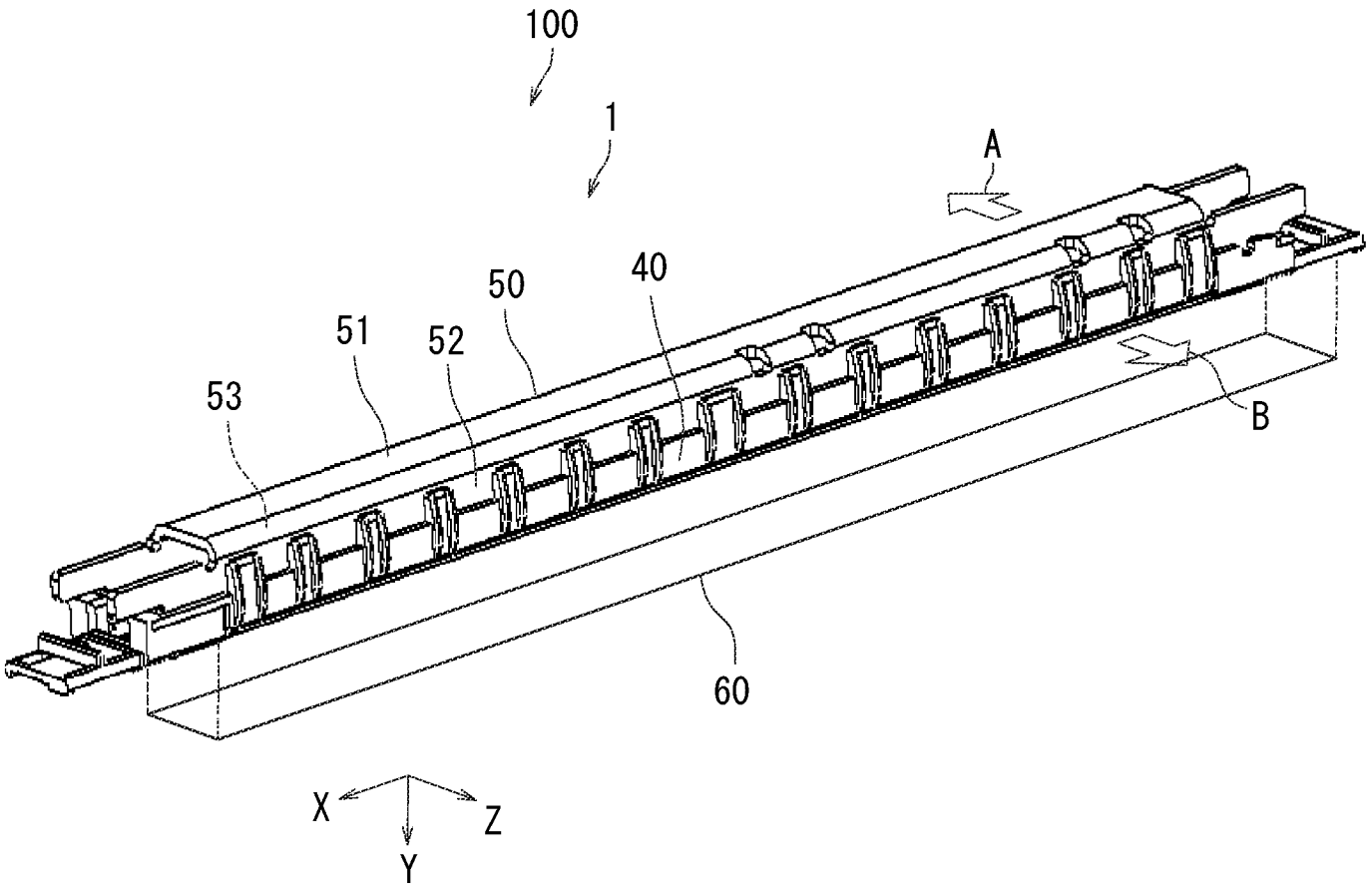
FIG. 4 is an outer perspective view of a heater holding member and a stay sheet metal of the fixing device in the first embodiment.

Next, a configuration of the fixing device 1 in the first embodiment is described in detail with reference to FIGS. 2 to 9. FIG. 2 is a perspective view of a main part of the fixing device 1 in the first embodiment. FIG. 3 is an outer perspective view of the fixing device 1 in the first embodiment with a fixing belt 10 removed therefrom. FIG. 4 is an outer perspective view of a heater holding member 40 and a stay sheet metal 50 of the fixing device 1 in the first embodiment.

Figure 5:
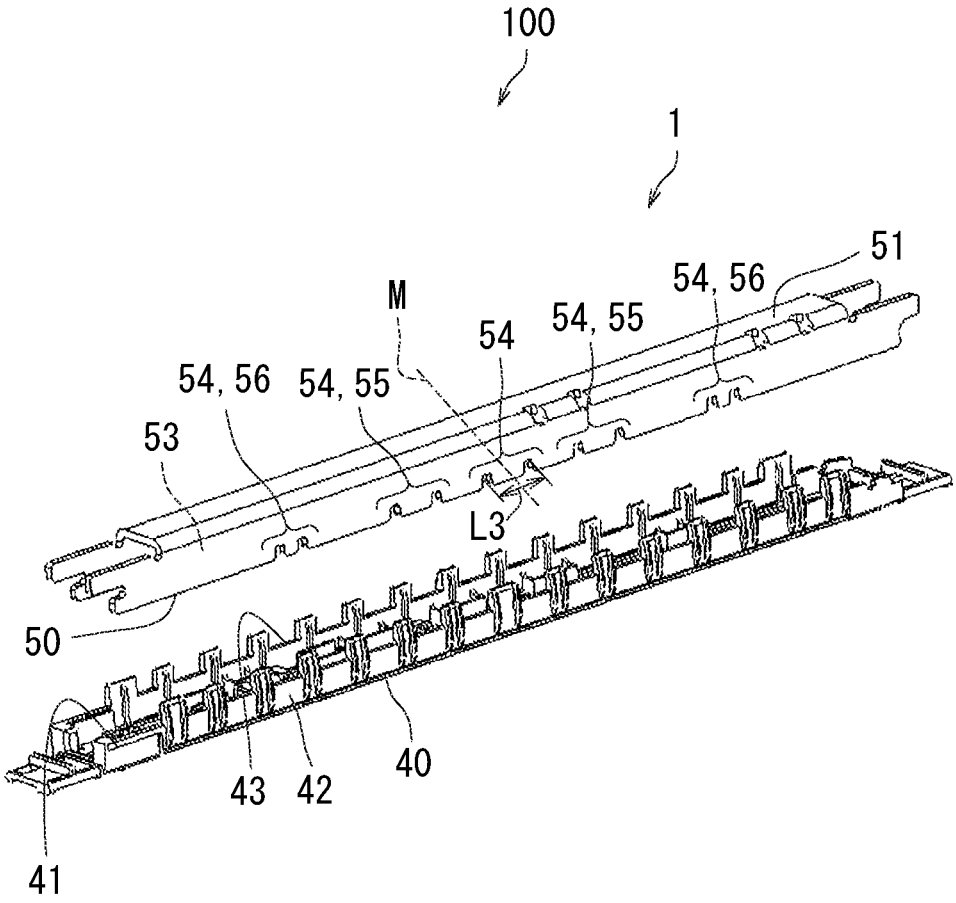
FIG. 5 is an outer perspective view of the heater holding member of the fixing device in the first embodiment with the stay sheet metal removed therefrom.
Figure 6:
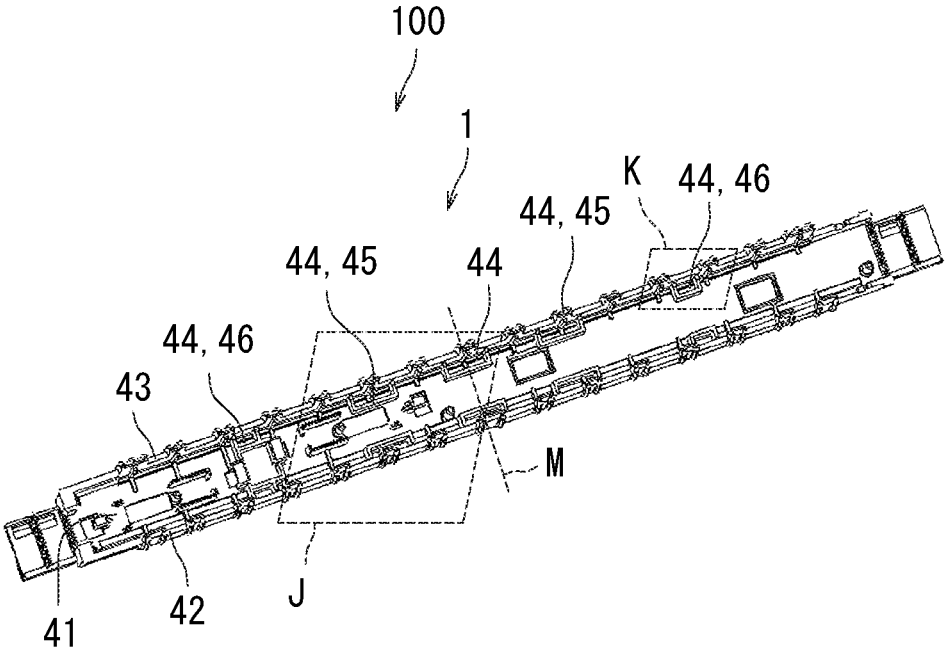
FIG. 6 is an outer perspective view of the heater holding member of the fixing device in the first embodiment.
Figure 7:
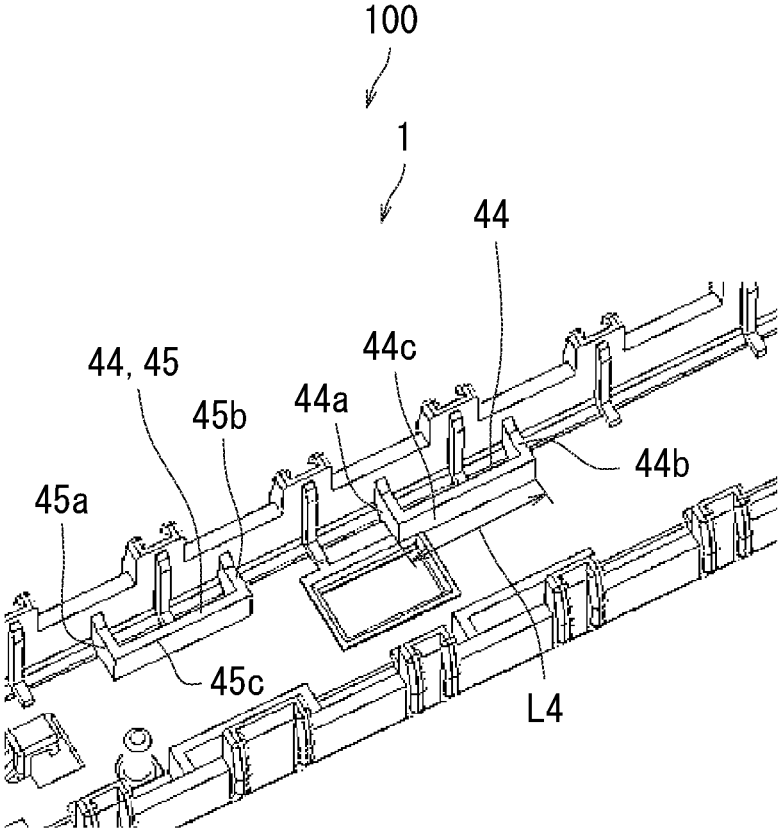
FIG. 7 is an enlarged view of a range J in FIG. 6.
Figure 8:
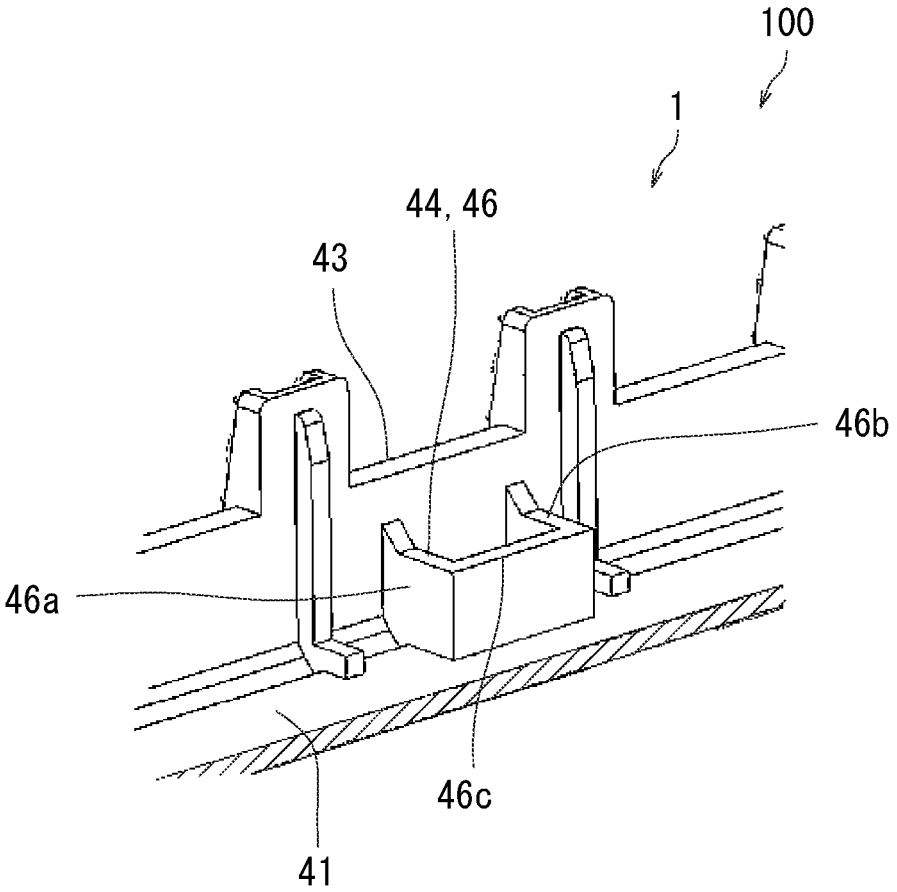
FIG. 8 is an enlarged view of a range K in FIG. 6.
Figure 9:
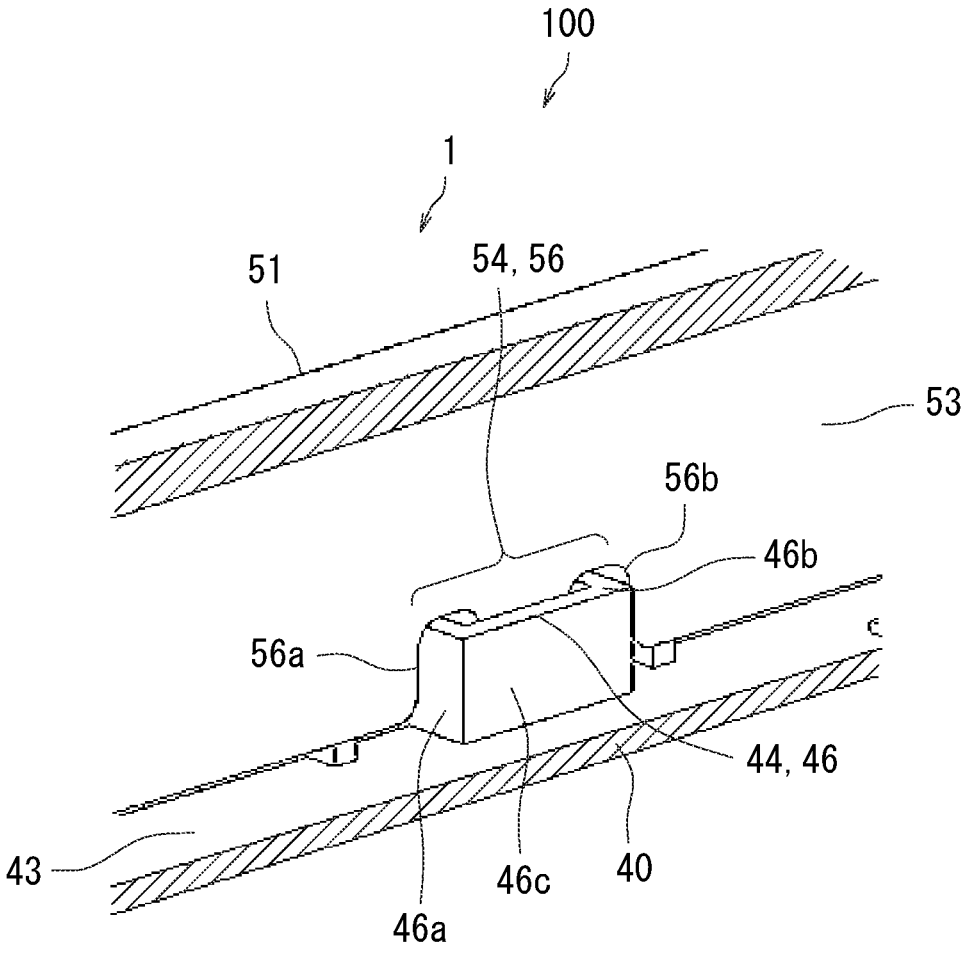
FIG. 9 is an outer perspective view of the heater holding member illustrated in FIG. 8 with the stay sheet metal attached thereto.

FIG. 5 is an outer perspective view of the heater holding member 40 of the fixing device 1 in the first embodiment with the stay sheet metal 50 removed therefrom. FIG. 6 is an outer perspective view of the heater holding member 40 of the fixing device 1 in the first embodiment. FIG. 7 is an enlarged view of a range J in FIG. 6. FIG. 8 is an enlarged view of a range K in FIG. 6. FIG. 9 is an outer perspective view of the heater holding member 40 illustrated in FIG. 8 with the stay sheet metal 50 attached thereto.

In the first embodiment, the fixing device 1 includes a fixing belt 10, a heater holding member 40, and a stay sheet metal 50. The fixing belt 10 heats the sheet S. The heater holding member 40 circulatably guides the fixing belt 10 and holds a heater 60 which heats the fixing belt 10. The stay sheet metal 50 reinforces the heater holding member 40.

The heater holding member 40 has a base plate 41, a side wall 42, and a side wall 43. The stay sheet metal 50 is placed on the base plate 41. The side walls 42 and 43 are erected on respective sides of the base plate 41 in the short direction thereof. Pockets 44 to 46 are formed in each of the side walls 42 and 43. The pockets 44 to 46 keep the stay sheet metal 50.

The stay sheet metal 50 has a top plate 51, a side plate 52, and a side plate 53. The side plates 52 and 53 bend and extend from respective edges of the top plate 51 in the short direction thereof. Slits 54 to 56 are formed in each of the side plates 52 and 53. The slits 54 to 56 are provided such that the side plates 52 and 53 are kept in the pockets 44 to 46 of the heater holding member 40.

Also in the first embodiment, a plurality of pockets 44 to 46 are formed in each of the side walls 42 and 43 of the heater holding member 40. The pockets 44 to 46 are formed in the longitudinal direction of the heater holding member 40 symmetrically with respect to a longitudinal center M of the heater holding member 40. The slits 54 to 56 are formed in positions at which the side plates 52 and 53 of the stay sheet metal 50 engage with the pockets 44 to 46.

The following describes the fixing device 1 in the first embodiment in detail with reference to FIGS. 1 to 9. As illustrated in FIGS. 2 and 3, the fixing device 1 includes the fixing belt 10, a pressure member 20, the belt holding member 30, the heater holding member 40, the stay sheet metal 50, and the heater 60.

As illustrated in FIG. 2, the fixing belt 10 heats the sheet S. After a toner image has been formed on the sheet S in the image forming section 2 illustrated in FIG. 1 and the sheet S has been conveyed to the fixing device 1, the fixing belt 10 heats the sheet S to fix the toner image to the sheet S.

The fixing belt 10 is an endless belt. The fixing belt 10 is substantially cylindrical. The fixing belt 10 is flexible. The fixing belt 10 is able to circulate around a first rotational axis L1. The fixing belt 10 extends widthwise along the first rotational axis L1.

The fixing belt 10 has an edge 11 and an edge 12. The edges 11 and 12 are opposite edges of the fixing belt 10 in the direction of the first rotational axis L1. In the following, the direction of the first rotational axis L1 may be referred to as a "rotational axis direction", a "rotational axis direction of the fixing belt 10", or a "width direction of the fixing belt 10".

The fixing belt 10 also has a plurality of layers. For example, the fixing belt 10 has a polyimide layer and a mold release layer. The mold release layer is formed on the outer circumferential surface of the polyimide layer. The mold release layer is a fluororesin heat-resistant film, for example.

The pressure member 20 makes close contact with the fixing belt 10 while rotating, and presses against the fixing belt 10. The pressure member 20 is substantially columnar, and is arranged opposite to the fixing belt 10. An example of the pressure member 20 is a pressure roller.

The pressure member 20 freely rotates around a second rotational axis L2. The pressure member 20 extends along the second rotational axis L2. Note that the second rotational axis L2 and the first rotational axis L1 are substantially parallel to each other.

When the pressure member 20 presses against the fixing belt 10, the heater 60 held by the heater holding member 40 inside the fixing belt 10 makes contact with the fixing belt 10. As such, the fixing belt 10 is heated by the heater 60.

The pressure member 20 has a columnar metal core 21, a cylindrical elastic layer 22, and a mold release layer 23. The elastic layer 22 is formed on the metal core 21. The mold release layer 23 is formed so as to cover the surface of the elastic layer 22.

The metal core 21 is freely rotatable around the second rotational axis L2. The metal core 21 is made of stainless steel or aluminum, for example. The elastic layer 22 is elastic and is made of silicone rubber, for example. The mold release layer 23 is made of fluororesin, for example.

The belt holding member 30 circulatably holds the fixing belt 10. The belt holding member 30 holds the edges 11 and 12 in the direction of the rotational axis (first rotational axis L1) of the fixing belt 10 such that the fixing belt 10 is able to circulate.

The belt holding member 30 has a first belt holding member 31 and a second belt holding member 32. The first belt holding member 31 circulatably holds the edge 11 of the fixing belt 10. The second belt holding member 32 circulatably holds the edge 12 of the fixing belt 10.

As illustrated in FIG. 3, the heater holding member 40 circulatably guides the fixing belt 10.

Furthermore, as illustrated in FIGS. 4 to 6, the heater holding member 40 has a base plate 41, a side wall 42, and a side wall 43. The stay sheet metal 50 is placed on the base plate 41. The side walls 42 and 43 are erected on respective sides of the base plate 41 in the short direction thereof.

The heater holding member 40 also holds the heater 60 which heats the fixing belt 10. The heater 60 can be attached to a surface of the heater holding member 40 opposite to the inner peripheral surface of the fixing belt 10. The heater holding member 40 can be attached to the belt holding member 30.

As illustrated in FIG. 4, the stay sheet metal 50 reinforces the heater holding member 40. The stay sheet metal 50 is a long and thin metal stay member, for example. As illustrated in FIG. 3, the stay sheet metal 50 extends along the first rotational axis L1. The stay sheet metal 50 may be formed in a square U-shape, a round U-shape, or a V-shape.

As illustrated in FIG. 5, the stay sheet metal 50 has a top plate 51, a side plate 52, and a side plate 53. The side plates 52 and 53 bend and extend from respective edges of the top plate 51 in the short direction thereof.

For example, as illustrated in FIG. 5, the stay sheet metal 50 is upside-down U-shaped and is set on the heater holding member 40 as illustrated in FIG. 4.

The heater 60 is connected to an unillustrated power source and generates heat. The heater 60 heats the fixing belt 10. The heater 60 extends along the first rotational axis L1. Examples of the heater 60 include a surface heater and a long thin plate heater. The heater 60 is for example a ceramic heater and includes a ceramic substrate and a resistive heating element. The heater 60 is 1 mm thick, for example. The heater 60 receives pressure from the pressure member 20 through the fixing belt 10.

Here, the heater holding member 40 is heated by the heater 60, and may therefore elongate in the directions of arrows A and B as indicated in FIG. 4. As such, the position of the heater 60 is offset with respect to a sheet S passing through the fixing device 1.

Therefore, in the first embodiment as illustrated in FIGS. 6 to 9, the pockets 44 to 46 which keep the stay sheet metal 50 are formed in the side walls 42 and 43 of the heater holding member 40.

In addition, as illustrated in FIG. 5, the slits 54 to 56 are formed in the side plates 52 and 53 of the stay sheet metal 50 such that the side plates 52 and 53 are kept in the pockets 44 to 46 of the heater holding member 40.

Specifically, as illustrated in FIG. 7, a pocket 44 has a lengthwise rim 44*a*, a lengthwise rim 44*b*, and a widthwise rim 44*c*. Similarly, a pocket 45 has a lengthwise rim 45*a*, a lengthwise rim 45*b*, and a widthwise rim 45*c*. In addition, as illustrated in FIG. 8, a pocket 46 has a lengthwise rim 46*a*, a lengthwise rim 46*b*, and a widthwise rim 46*c*.

As illustrated in FIG. 5, the slits 54 to 56 are each composed of a combination of two slits.

The slit 54 illustrated in FIG. 5 is fitted into the pocket 44 illustrated in FIG. 6. Accordingly, as illustrated in FIG. 7, an interval L4 between the lengthwise rim 44*a* and the lengthwise rim 44*b* of the pocket 44 is established so as to conform to an interval L3 of the slit 54 illustrated in FIG. 5.

Similarly, the slits 55 illustrated in FIG. 5 are fitted to the pockets 45 illustrated in FIG. 6. The slits 56 illustrated in FIG. 5 are fitted into the pockets 46 illustrated in FIG. 6.

When the stay sheet metal 50 is set on the heater holding member 40, the slits 54 to 56 are fitted into the respective pockets 44 to 46 as illustrated in FIG. 9. For example, a pair of slits 56*a* and 56*b* are fitted to respective lengthwise rims 46*a* and 46*b* of a pocket 46. Accordingly, the area between the slits 56*a* and 56*b* of the side plate 53 is locked to the pocket 46.

As such, the widthwise rims 44*c* to 46*c* of the pockets 44 to 46 of the heater holding member 40 correspond to the respective side plates 52 and 53 of the stay sheet metal 50 even when the side walls 42 and 43 of the heater holding member 40 are elongated in the directions of the arrows A and B as described in FIG. 4.

Accordingly, elongation of the heater holding member 40 due to the heat of the heater 60 can be suppressed by the stay sheet metal 50.

According to the present embodiment, elongation of the heater holding member 40 can be suppressed.

In addition, as illustrated in FIG. 6, a plurality of pockets 44 to 46 are formed in each of the side walls 42 and 43 of the heater holding member 40. The pockets 44 to 46 may be formed in the longitudinal direction of the heater holding member 40 symmetrically with respect to the longitudinal center M of the heater holding member 40.

As a specific example, the pockets 44, 45, and 46 are formed in the side walls 42 and 43 of the heater holding member 40. The number of pockets 44 can be established appropriately.

Furthermore, the pockets 45 may be formed in the longitudinal direction of the heater holding member 40 symmetrically with respect to the longitudinal center M. The pockets 46 may be formed in the longitudinal direction of the heater holding member 40 symmetrically with respect to the longitudinal center M.

According to the present embodiment, elongation of the heater holding member 40 can be evenly suppressed.

Second Embodiment

Next, the fixing device 1 according to a second embodiment is described with reference to FIGS. 10 to 12 in addition to FIGS. 1 to 9. In the second embodiment, FIGS. 1 to 9 are referred to as appropriate to describe the configuration of the heater holding member 40 according to the second embodiment.

Figure 10:
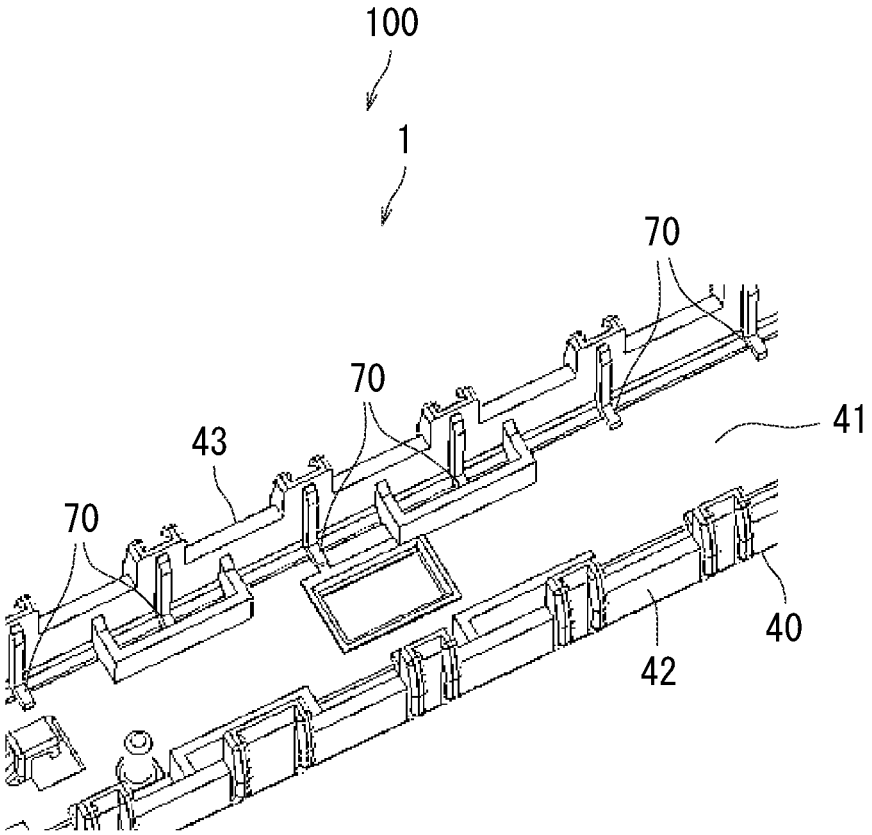
FIG. 10 is an outer perspective view of the heater holding member of the fixing device according to a second embodiment of the present disclosure.

FIG. 10 is an outer perspective view of the heater holding member 40 of the fixing device 1 according to the second embodiment. FIG. 11 is an outer perspective view of the heater holding member 40 and the stay sheet metal 50 of the fixing device 1 in the second embodiment. FIG. 12 is a cross-sectional view taken along line XII-XII shown in FIG. 11.

In the second embodiment, the fixing device 1 includes a fixing belt 10, a heater holding member 40, and a stay sheet metal 50. The fixing belt 10 heats a sheet S. The heater holding member 40 circulatably guides the fixing belt 10 and holds a heater 60 which heats the fixing belt 10. The stay sheet metal 50 reinforces the heater holding member 40.

The stay sheet metal 50 has a top plate 51, a side plate 52, and a side plate 53. The side plates 52 and 53 bend and extend from respective edges of the top plate 51 in the short direction thereof.

The heater holding member 40 has a base plate 41 on which the stay sheet metal 50 is placed, and pedestal ribs 70 which support the side plates 52 and 53 of the stay sheet metal 50 are erected on the base plate 41.

In addition, in the second embodiment, a plurality of pedestal ribs 70 to 73 are arranged in the longitudinal direction of the heater holding member 40 symmetrically with respect to a longitudinal center F of the heater holding member 40 and are erected such that a height H of the pedestal ribs 70 to 73 gradually decreases from the longitudinal center F toward longitudinal edges G of the heater holding member 40.

In the following, description of configuration shared with the first embodiment is omitted, and configuration differing from that of the first embodiment is mainly described.

As illustrated in FIG. 10, the pedestal ribs 70 which support the side plates 52 and 53 of the stay sheet metal 50 are erected on the base plate 41 of the heater holding member 40.

Figure 12:
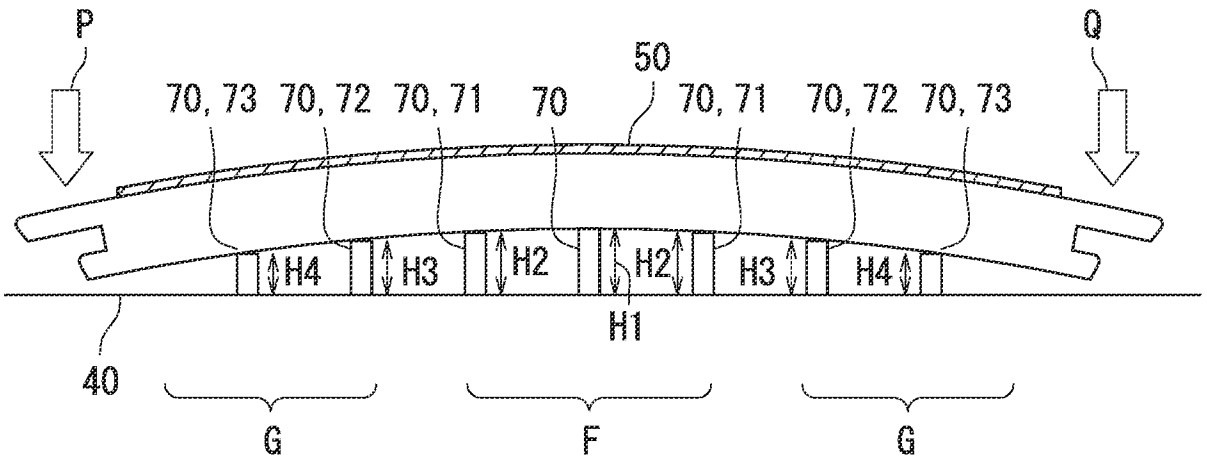
FIG. 12 is a cross-sectional view taken along line XII-XII shown in FIG. 11.

As illustrated in FIG. 12, the pedestal ribs 70 to 73 are arranged in the longitudinal direction of the heater holding member 40 symmetrically with respect to the longitudinal center F of the heater holding member 40 and are erected such that the height H of the pedestal ribs 70 to 73 gradually decreases from the longitudinal center F toward the longitudinal edges G of the heater holding member 40.

Figure 11:
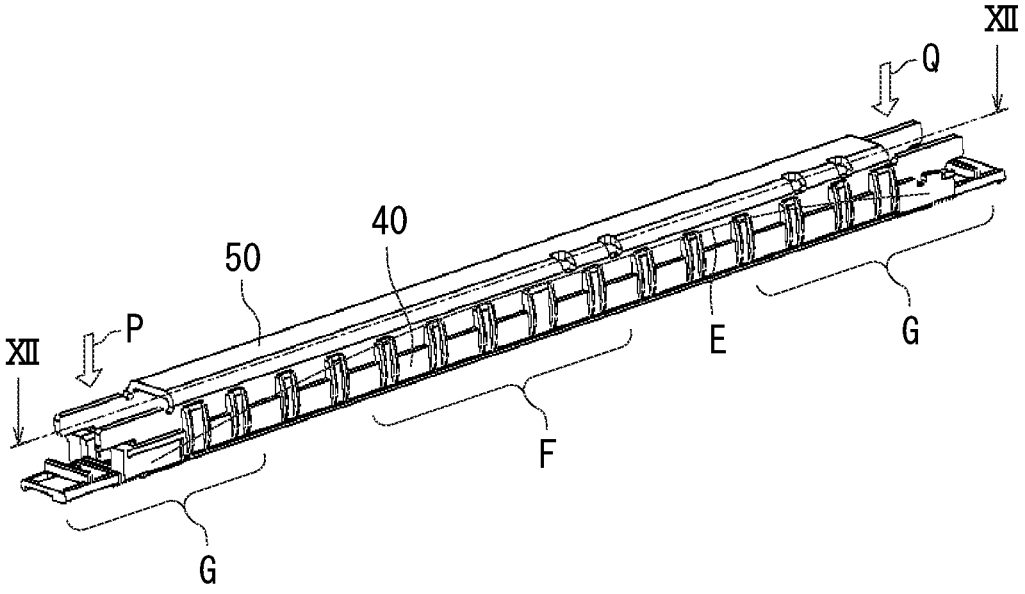
FIG. 11 is an outer perspective view of the heater holding member and the stay sheet metal of the fixing device in the second embodiment.

Specifically, as illustrated in FIG. 11, the heater holding member 40 on which the stay sheet metal 50 has been set is pressed by an unillustrated pressing section as indicated by arrows P and Q.

As such, the stay sheet metal 50 curves as indicated by a curved line E, and the heater holding member 40 also curves accordingly. When the heater holding member 40 curves, the pressing force decreases on the heater holding member 40 in the longitudinal center F of the pressure member 20 illustrated in FIG. 2. The pressing force then increases on the heater holding member 40 in the longitudinal edges G of the pressure member 20.

Accordingly, the pressing force of the pressure member 20 on the heater holding member 40 is unevenly distributed, causing problems with fixation of a toner image on a sheet S.

Therefore, in the second embodiment as illustrated in FIG. 10, the pedestal ribs 70 which support the side plates 52 and 53 of the stay sheet metal 50 are erected on the base plate 41 of the heater holding member 40. The stay sheet metal 50 is set on the pedestal ribs 70.

As illustrated in FIG. 12, a plurality of pedestal ribs 70 may be erected, such as the pedestal ribs 70 to 73.

In addition, a height H1 of the pedestal rib 70, a height H2 of the pedestal ribs 71, a height H3 of the pedestal ribs 72, and a height H4 of the pedestal ribs 73 may be erected so as to gradually decrease from the longitudinal center F toward the longitudinal edges G of the heater holding member 40.

Specifically, the height H may be established as follows: height H1>height H2>height H3>height H4.

By establishing the heights H1 to H4 of the pedestal ribs 70 to 73 as above, curving of the heater holding member 40 can be suppressed even when the stay sheet metal 50 and the heater holding member 40 are pressed by an unillustrated pressing section as indicated by the arrows P and Q in FIG. 12.

By extension, the unevenness of the pressing force of the pressure member 20 on the heater holding member 40 is suppressed, and problems with fixation of a toner image on a sheet S are suppressed.

According to the present embodiment, problems with fixation of a toner image on a sheet S can be suppressed.

Embodiments of the present disclosure are described above with reference to the accompanying drawings. However, the present disclosure is not limited to the above embodiments and may be implemented in various manners within a scope not departing from the gist thereof. The drawings mainly illustrate constituent elements schematically to facilitate understanding. Aspects such as thickness, length, and interval of the constituent elements illustrated in the drawings may differ in practice for convenience of drawing preparation. Furthermore, aspects such as material, shape, and dimension of the constituent elements described in the above embodiments are only examples and not particular limitations. The constituent elements may be variously altered within a scope not substantially departing from the effects of the present disclosure.

What is claimed is:

1. A fixing device comprising:

a fixing belt configured to heat a sheet;

a heater holding member which circulatably guides the fixing belt and holds a heater that heats the fixing belt; and a stay sheet metal which reinforces the heater holding member, wherein the heater holding member has:

a base plate on which the stay sheet metal is placed; and a side wall erected on either side of the base plate in a short direction thereof, a pocket which keeps the stay sheet metal is formed in each side wall, the stay sheet metal has:

a top plate; and a side plate bending and extending from either edge of the top plate in a short direction thereof, a slit is formed in each side plate such that the side plates are kept in the pockets of the heater holding member, the heater holding member further has pedestal ribs erected on the base plate, each pedestal rib holding a corresponding side plate of the stay sheet metal, and a plurality of pedestal ribs hold each side plate, and the pedestal ribs are arranged in a longitudinal direction of the heater holding member symmetrically with respect to a longitudinal center of the heater holding member and are erected such that a height of the pedestal ribs gradually decreases from the longitudinal center toward longitudinal edges of the heater holding member.

2. The fixing device according to claim 1, wherein a plurality of pockets are formed in each side wall of the heater holding member, the pockets are formed in a longitudinal direction of the heater holding member symmetrically with respect to a longitudinal center of the heater holding member, and a plurality of slits are formed in positions at which the side plates of the stay sheet metal engage with the pockets.

3. An image forming apparatus comprising:

the fixing device according to claim 1; and an image forming section configured to form a toner image on the sheet.

* * * * *